US007082863B1

(12) United States Patent
Wang

(10) Patent No.: US 7,082,863 B1
(45) Date of Patent: Aug. 1, 2006

(54) SOCKET ADAPTER

(76) Inventor: Shyh Ming Wang, No. 22, Lane 427, Dasheng Street, Taichung City 408 (TW)

( * ) Notice: Subject to any disclaimer, the term of this patent is extended or adjusted under 35 U.S.C. 154(b) by 0 days.

(21) Appl. No.: 10/917,040

(22) Filed: Aug. 13, 2004

Related U.S. Application Data

(63) Continuation-in-part of application No. 10/279,810, filed on Oct. 21, 2002, now abandoned.

(51) Int. Cl.
*B25B 23/16* (2006.01)

(52) U.S. Cl. ..... 81/177.85; 81/177.5

(58) Field of Classification Search ..... 81/177.85, 81/177.2, 177.5, 177.75; 411/348; 403/322.2, 403/322.4, 325
See application file for complete search history.

(56) References Cited

U.S. PATENT DOCUMENTS

| | | | | | |
|---|---|---|---|---|---|
| 1,438,165 | A | * | 12/1922 | Ayotte | 81/473 |
| 1,457,570 | A | * | 6/1923 | Guthard | 81/177.5 |
| 3,052,148 | A | * | 9/1962 | Price et al. | 411/348 |
| 4,696,208 | A | * | 9/1987 | Lay | 81/58 |
| 5,897,198 | A | * | 4/1999 | Hsieh | 362/119 |
| 6,003,414 | A | * | 12/1999 | Hsieh | 81/177.85 |
| 6,006,632 | A | * | 12/1999 | Hsieh | 81/177.85 |
| 6,145,416 | A | * | 11/2000 | Bonniot | 81/177.75 |
| 6,257,096 | B1 | * | 7/2001 | Ling | 81/60 |
| 6,267,032 | B1 | * | 7/2001 | Hsieh | 81/177.85 |
| 6,874,392 | B1 | * | 4/2005 | Wu | 81/177.85 |
| 6,901,827 | B1 | * | 6/2005 | Yen | 81/177.85 |
| 7,007,574 | B1 | * | 3/2006 | Wu | 81/177.85 |

* cited by examiner

*Primary Examiner*—Hadi Shakeri

(57) ABSTRACT

A socket adapter includes a main body, a movable member, an elongated rod, a ball, and an elastic member. Thus, the socket adapter is mounted on a socket to provide a torque on the socket so as to rotate the socket. In addition, the socket adapter is mounted on and detached from the socket easily and conveniently.

8 Claims, 15 Drawing Sheets

SOCKET ADAPTER

CROSS-REFERENCES TO RELATED APPLICATIONS

The present invention is a continuation-in-part application of the U.S. Ser. No. 10/279,810 filed Oct. 21, 2002 now abandoned.

BACKGROUND OF THE INVENTION

1. Field of the Invention

The present invention relates to a socket adapter, and more particularly to a socket adapter that is mounted on a socket to provide a torque to the socket so as to rotate the socket.

2. Description of the Related Art

A conventional socket adapter in accordance with the prior art was disclosed in U.S. Pat. No. 6,003,414. However, the conventional socket adapter has a complicated construction, thereby increasing the cost of fabrication.

A conventional ball detent fastener with ball and socket plunger assembly in accordance with the prior art was disclosed in U.S. Pat. No. 3,052,148 to Price et al. In the Price et al. reference, the main body 10 has a cylindrical smaller portion 24, so that when the rod 78 is rotated, the cylindrical smaller portion 24 of the main body 10 cannot be used to provide a torque to a socket so as to rotate the socket. Thus, the main body 10 is used to receive sockets 18, 20 and 22 and cannot be used to rotate the sockets 18, 20 and 22.

Other prior art references known by the applicant were disclosed in U.S. Pat. No. 3,277,767 to Allen et al.; U.S. Pat. No. 5,605,082 to Tarpill; U.S. Pat. No. 6,067,881 to Albertson; U.S. Pat. No. 6,145,416 to Bonniot; U.S. Pat. No. 1,456,290 to Tell; and U.S. Pat. No. 1,457,570 to Guthard.

SUMMARY OF THE INVENTION

The primary objective of the present invention is to provide a socket adapter that is mounted on a socket to provide a torque on the socket so as to rotate the socket.

Another objective of the present invention is to provide a socket adapter that is mounted on and detached from the socket easily and conveniently.

Further benefits and advantages of the present invention will become apparent after a careful reading of the detailed description with appropriate reference to the accompanying drawings.

DETAILED DESCRIPTION OF THE INVENTION

Figure 1:
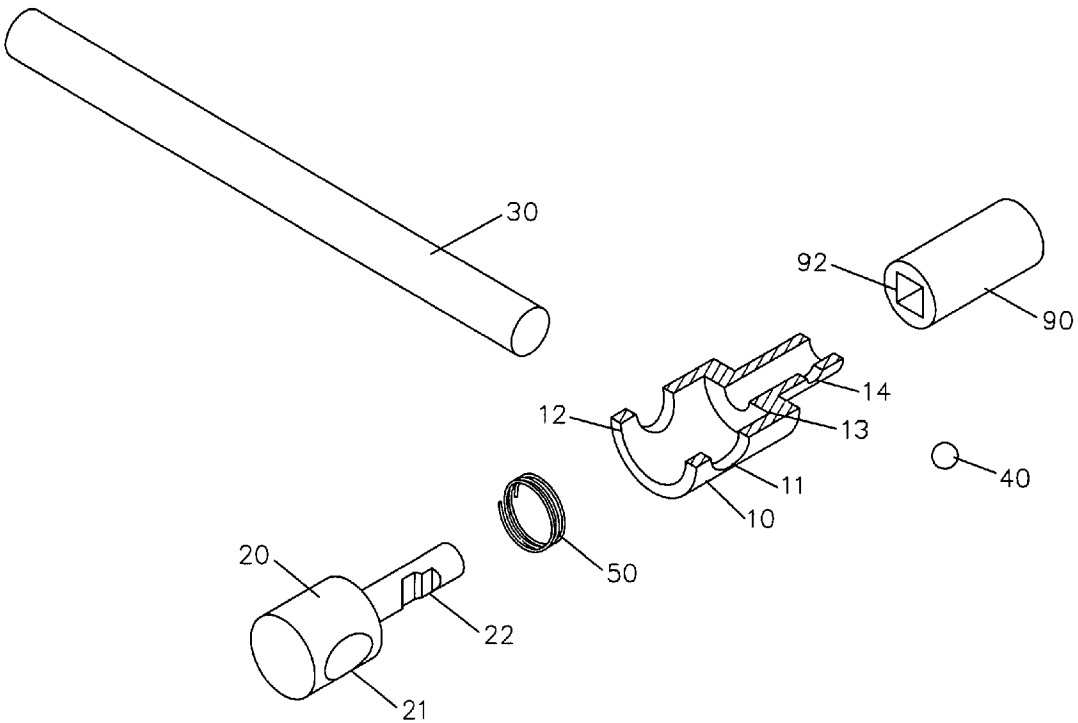
FIG. 1 is a partially cross-sectional exploded perspective view of a socket adapter in accordance with a first embodiment of the present invention.
Figure 2:
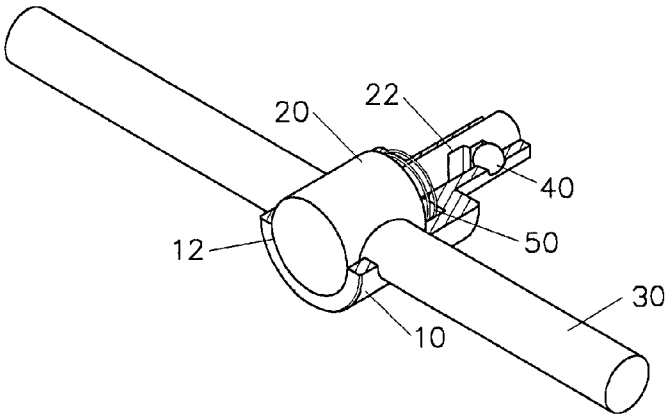
FIG. 2 is a perspective assembly view of the socket adapter as shown in FIG. 1.
Figure 3:
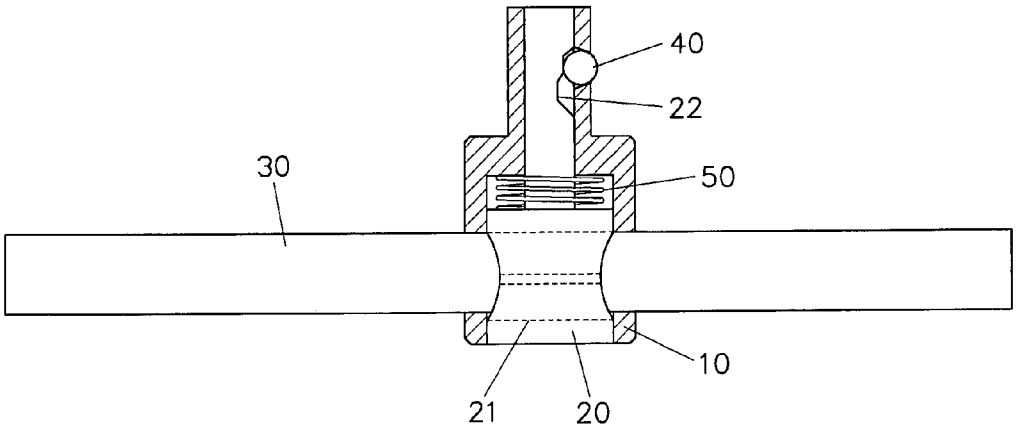
FIG. 3 is a top plan cross-sectional view of the socket adapter as shown in FIG. 2.

Referring to the drawings and initially to FIGS. 1–3, a socket adapter in accordance with a first embodiment of the present invention comprises a main body 10, a movable member 20, an elongated rod 30, a ball 40, and an elastic member 50.

The main body 10 has a stepped configuration and has an inner wall that defines a stepped receiving chamber 12. The stepped configuration of the main body 10 includes a larger portion with a through hole 11 and a square smaller portion with a ball receiving hole 14. The stepped receiving chamber 12 includes a larger portion in communication with the through hole 11 and a smaller portion in communication with the receiving hole 14. The inner wall of the main body 10 includes a shoulder 13 between the larger and smaller portions of the receiving chamber 12.

The movable member 20 having a stepped configuration is movably mounted in the receiving chamber 12 of the main body 10. The movable member 20 has a larger portion with an elongated hole 21 aligning with the through hole 11 of the main body 10, and a smaller portion with a stepped face 22 aligning with the ball receiving hole 14 of the main body 10. The elongated hole 21 of the movable member 20 has a length greater than the diameter of the through hole 11 of the main body 10. The movable member 20 can be pushed further into the receiving chamber 12 of the main body 10 through a determined distance. The larger portion of the movable member 20 has an end flush with an end face of the main body 10 as shown in FIG. 3.

The elongated rod 30 is extended through the through hole 11 of the main body 10 and the elongated hole 21 of the movable member 20 and is protruded outward from the main body 10. The elongated rod 30 is slidable axially in the elongated hole 21 of the movable member 20. The elongated rod 30 has a length greater than the diameter of the main body 10 to provide a torque to rotate the main body 10. The elongated rod 30 has a cross-section having a shape substantially matching that of the through hole of the main body 10.

The ball 40 is mounted in the ball receiving hole 14 of the main body 10 and is rested on the stepped face 22 of the movable member 20.

The elastic member 50 is mounted in the receiving chamber 12 of the main body 10 and has a first end urged on the shoulder 13 of the main body 10 and a second end urged on the larger portion of the movable member 20.

In assembly, the elastic member 50 is mounted in the receiving chamber 12 of the main body 10 with its first end rested on the shoulder 13 of the main body 10. Then, the movable member 20 is mounted in the receiving chamber 12 of the main body 10 and is rested on the elastic member 50, so that the first end of the elastic member 50 is urged on the shoulder 13 of the main body 10 and the second end of the elastic member 50 is urged on the larger portion of the movable member 20. Then, the elongated rod 30 is extended through the through hole 11 of the main body 10 and the elongated hole 21 of the movable member 20. Then, the ball 40 is pressed into the ball receiving hole 14 of the main body 10 and is rested on the stepped face 22 of the movable member 20, thereby forming the socket adapter.

Figure 4:
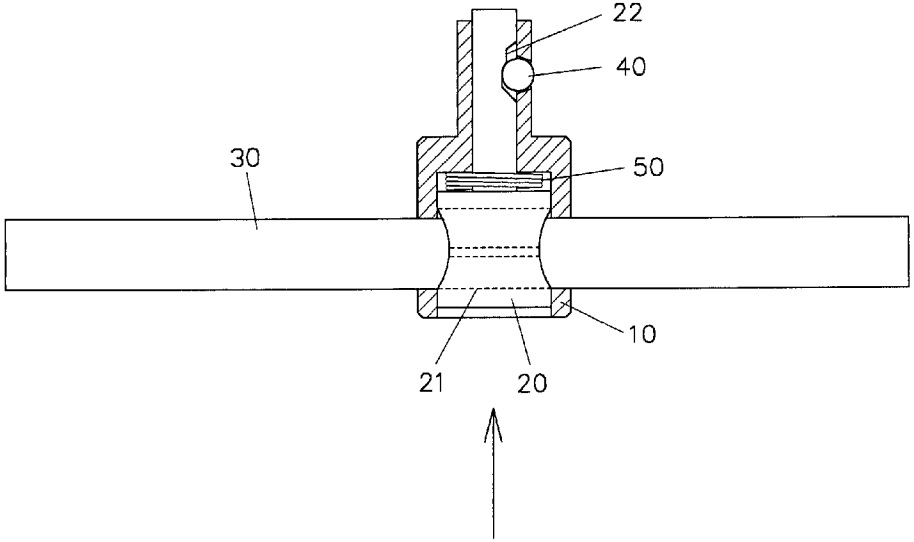
FIG. 4 is a schematic operational view of the socket adapter as shown in FIG. 3.

In operation, referring to FIGS. 3 and 4 with reference to FIGS. 1 and 2, the stepped face 22 of the movable member 20 has a shallower portion rested on the ball 40, so that the ball 40 is protruded outward from the ball receiving hole 14 of the main body 10 as shown in FIG. 3. Then, the larger portion of the movable member 20 is pushed by the user to move the movable member 20 into the receiving chamber 12 of the main body 10, so that the ball 40 is inserted into a deeper portion of the stepped face 22 of the movable member 20, and is fully retracted into the ball receiving hole 14 of the main body 10 as shown in FIG. 4. Thus, a socket 90 is mounted on or detached from the square smaller portion of the main body 10 easily and conveniently by pushing the movable member 20. The socket 90 has an inside formed with a square recess 92, and the square smaller portion of the main body 10 is inserted into the square recess 92 of the socket 90, so that when the elongated rod 30 is rotated, the main body 10 is rotated to provide a torque to the socket so as to rotate the socket.

It is appreciated that, when the movable member 20 is moved in the stepped receiving chamber 12 of the main body 10, the elongated rod 30 is moved in the elongated hole 21 of the movable member 20, thereby preventing the elongated rod 30 from interfering with movement of the movable member 20.

Figure 5:
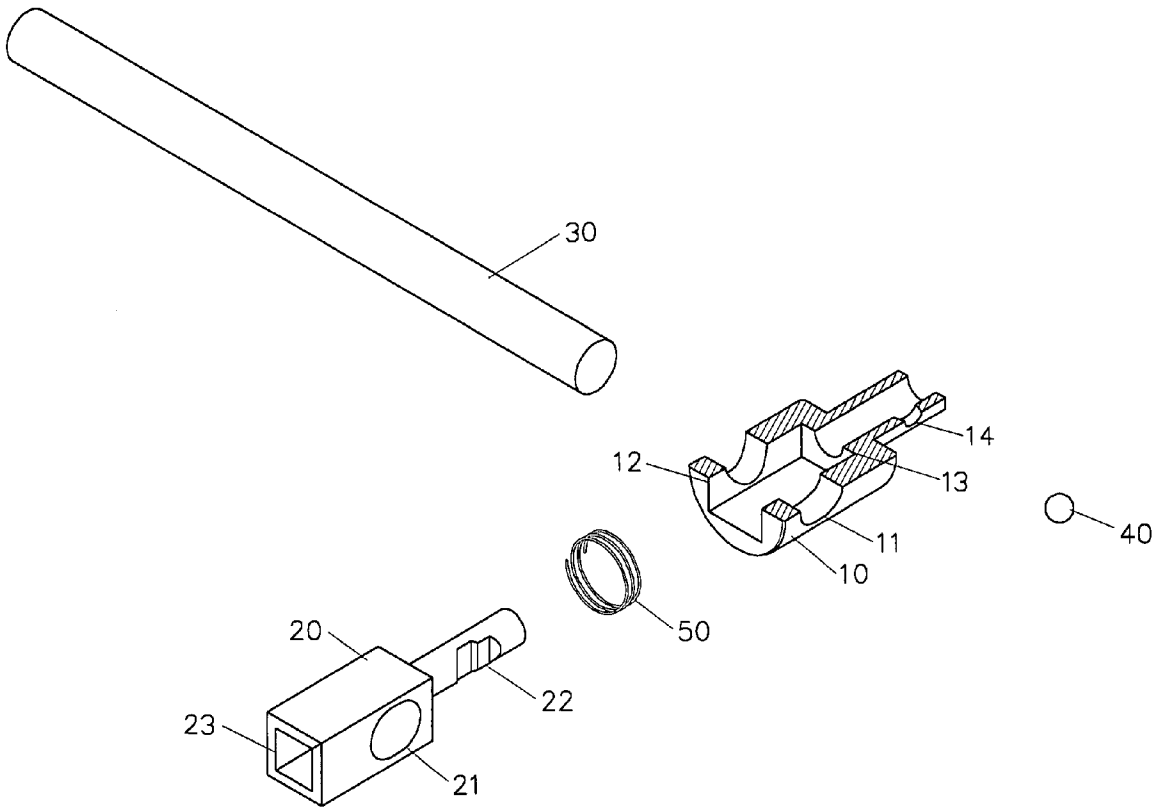
FIG. 5 is a partially cross-sectional exploded perspective view of a socket adapter in accordance with a second embodiment of the present invention.

Referring to FIG. 5, a socket adapter in accordance with a second embodiment of the present invention is shown, wherein the larger portion of the movable member 20 is formed with a square recess 23 for mounting a ratchet wrench or a socket wrench.

Figure 6:
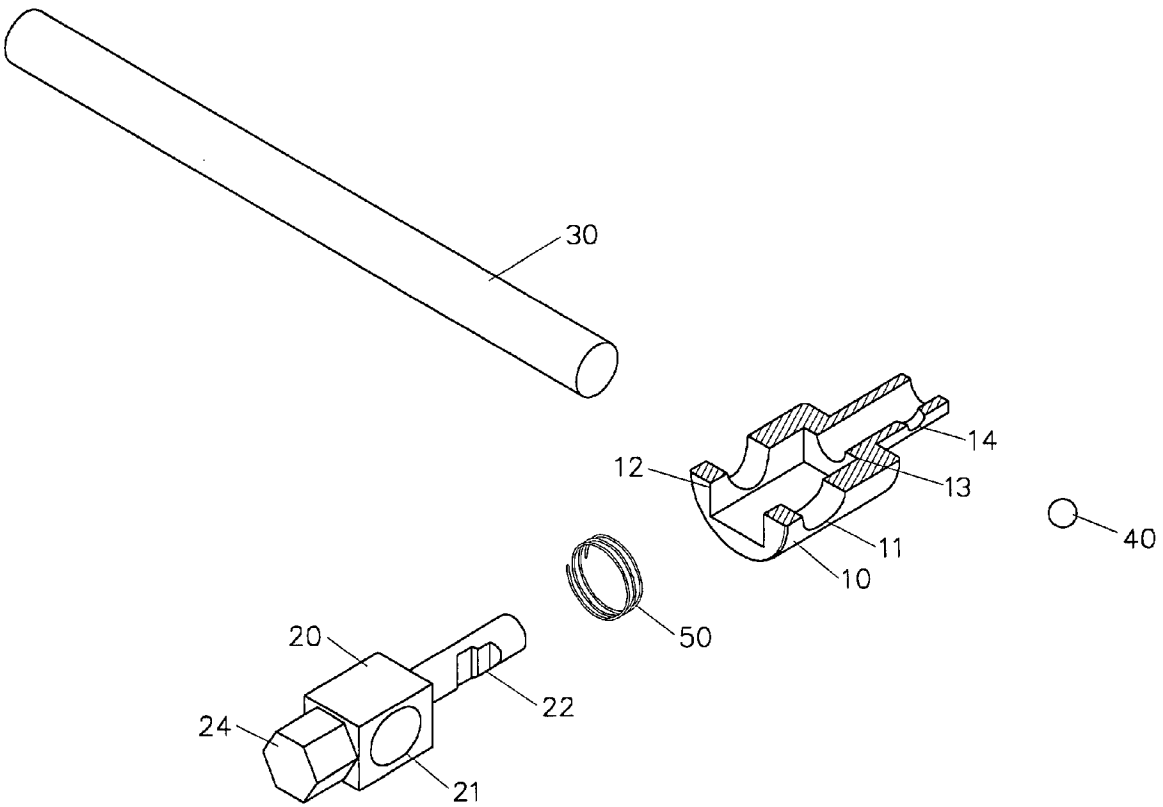
FIG. 6 is a partially cross-sectional exploded perspective view of a socket adapter in accordance with a third embodiment of the present invention.

Referring to FIG. 6, a socket adapter in accordance with a third embodiment of the present invention is shown, wherein the larger portion of the movable member 20 is formed with a hexagonal head 24 to co-operate with an open-ended or close-ended wrench.

Figure 7:
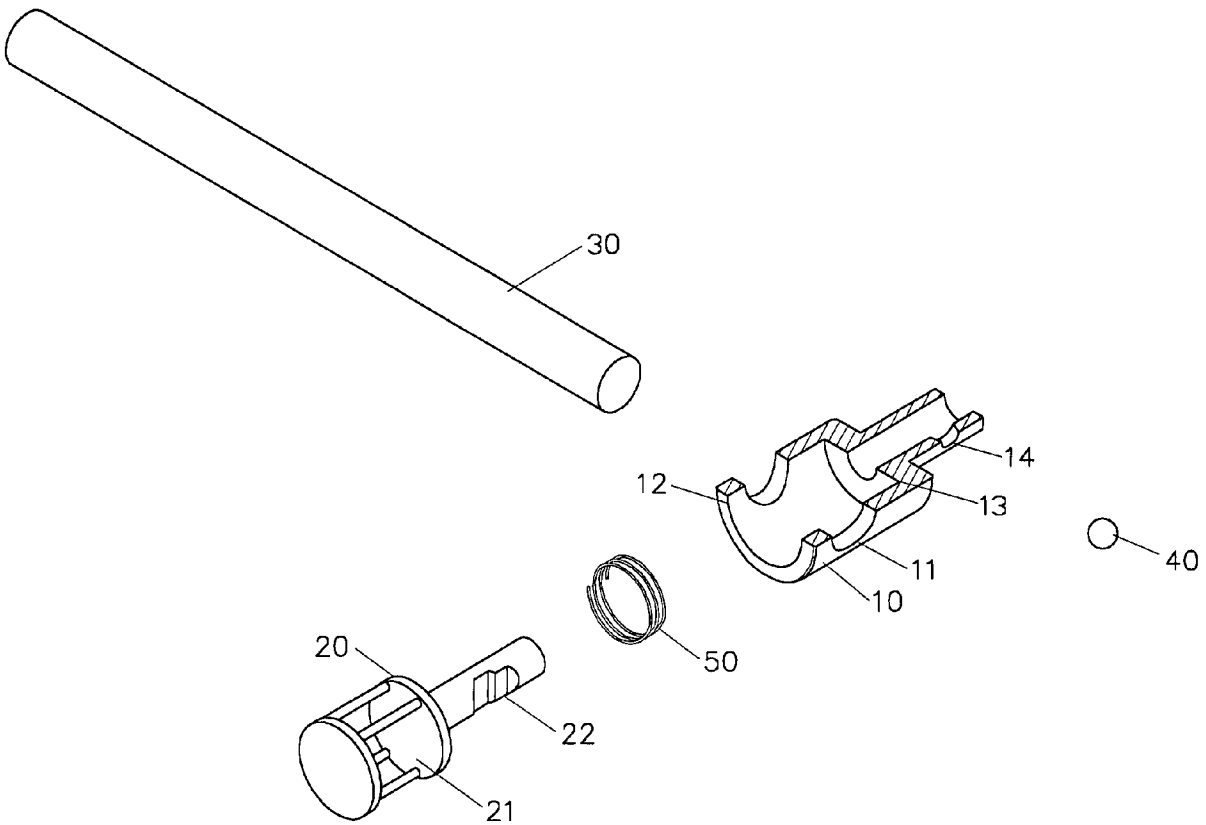
FIG. 7 is a partially cross-sectional exploded perspective view of a socket adapter in accordance with a fourth embodiment of the present invention.

Referring to FIG. 7, a socket adapter in accordance with a fourth embodiment of the present invention is shown, wherein the elongated hole 21 of the movable member 20 has a perforated shape.

Figure 8:
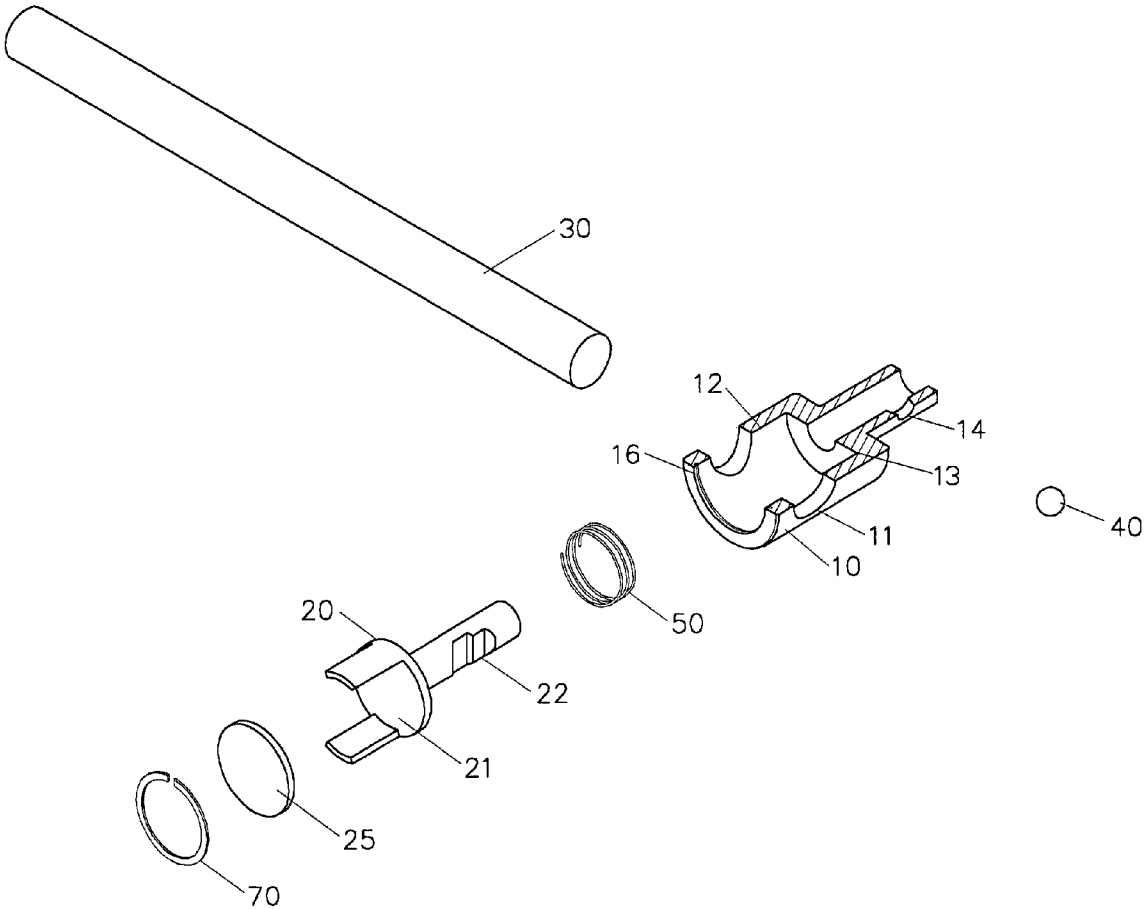
FIG. 8 is a partially cross-sectional exploded perspective view of a socket adapter in accordance with a fifth embodiment of the present invention.

Referring to FIG. 8, a socket adapter in accordance with a fifth embodiment of the present invention is shown, wherein the inner wall of the main body 10 is formed with an annular groove 16, and the socket adapter further comprises a push member 25 mounted in the receiving chamber 12 of the main body 10 and rested on the larger portion of the movable member 20, and a C-shaped snap ring 70 secured in the annular groove 16 of the main body 10 and rested on the push member 25, thereby preventing the push member 25 from detaching from the receiving chamber 12 of the main body 10. Thus, the push member 25 is pushed to move the movable member 20 in the receiving chamber 12 of the main body 10.

Figure 9:
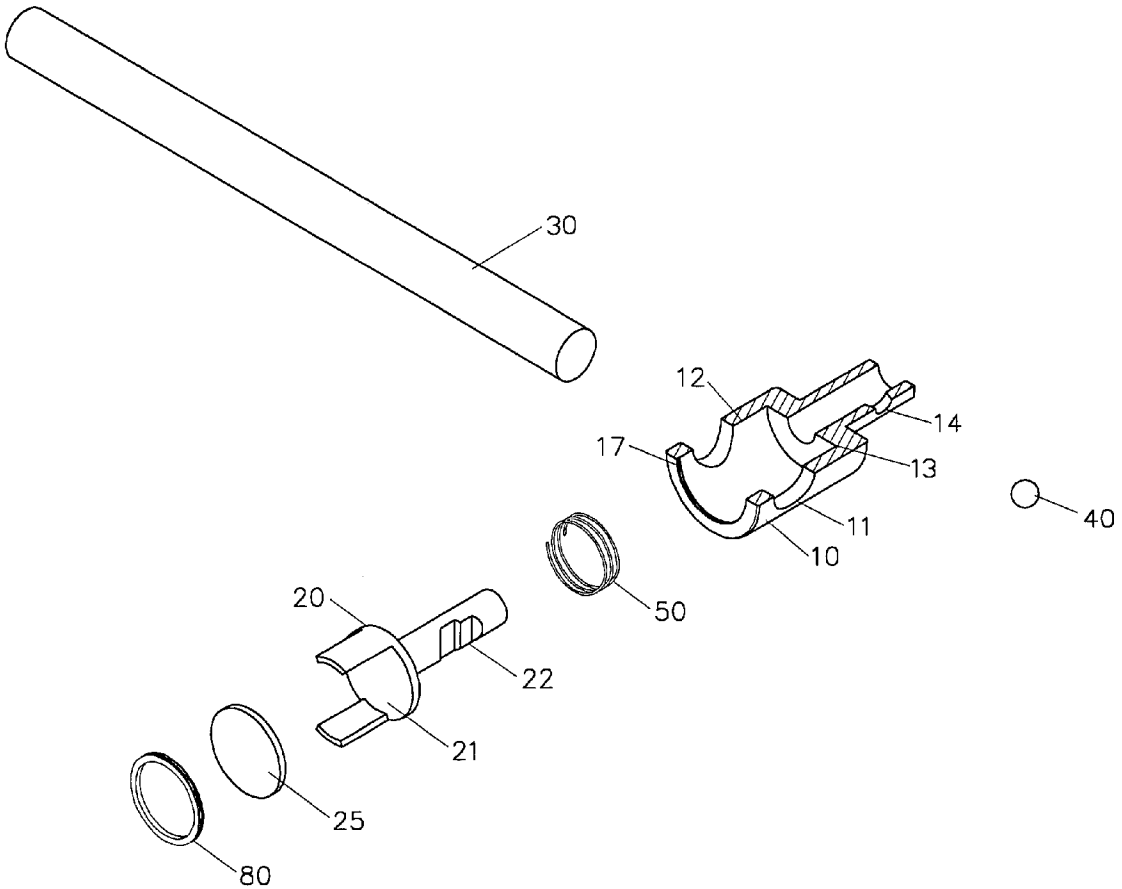
FIG. 9 is a partially cross-sectional exploded perspective view of a socket adapter in accordance with a sixth embodiment of the present invention.

Referring to FIG. 9, a socket adapter in accordance with a sixth embodiment of the present invention is shown, wherein the inner wall of the main body 10 is formed with an inner threaded portion 17, and the socket adapter further comprises a push member 25 mounted in the receiving chamber 12 of the main body 10 and rested on the larger portion of the movable member 20, and a screw member 80 screwed into the inner threaded portion 17 of the main body 10 and rested on the push member 25, thereby preventing the push member 25 from detaching from the receiving chamber 12 of the main body 10. Thus, the push member 25 may be pushed to move the movable member 20 in the receiving chamber 12 of the main body 10.

Figure 10:
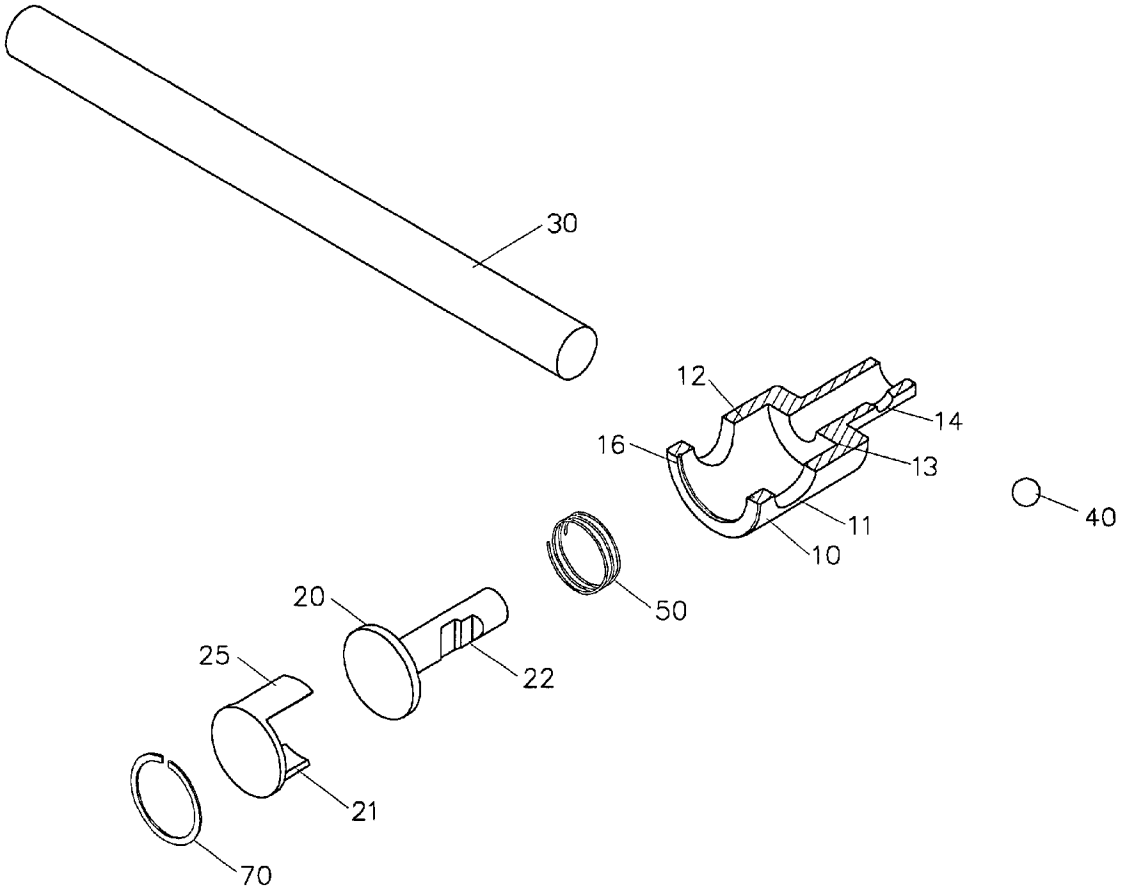
FIG. 10 is a partially cross-sectional exploded perspective view of a socket adapter in accordance with a seventh embodiment of the present invention.

Referring to FIG. 10, a socket adapter in accordance with a seventh embodiment of the present invention is shown, wherein the inner wall of the main body 10 is formed with an annular groove 16, the movable member 20 is substantially T-shaped, and the socket adapter further comprises a substantially U-shaped push member 25 mounted in the receiving chamber 12 of the main body 10 and rested on the larger portion of the movable member 20, and a C-shaped snap ring 70 secured in the annular groove 16 of the main body 10 and rested on the push member 25, thereby preventing the push member 25 from detaching from the receiving chamber 12 of the main body 10. Thus, the push member 25 may be pushed to move the movable member 20 in the receiving chamber 12 of the main body 10.

Figure 11:
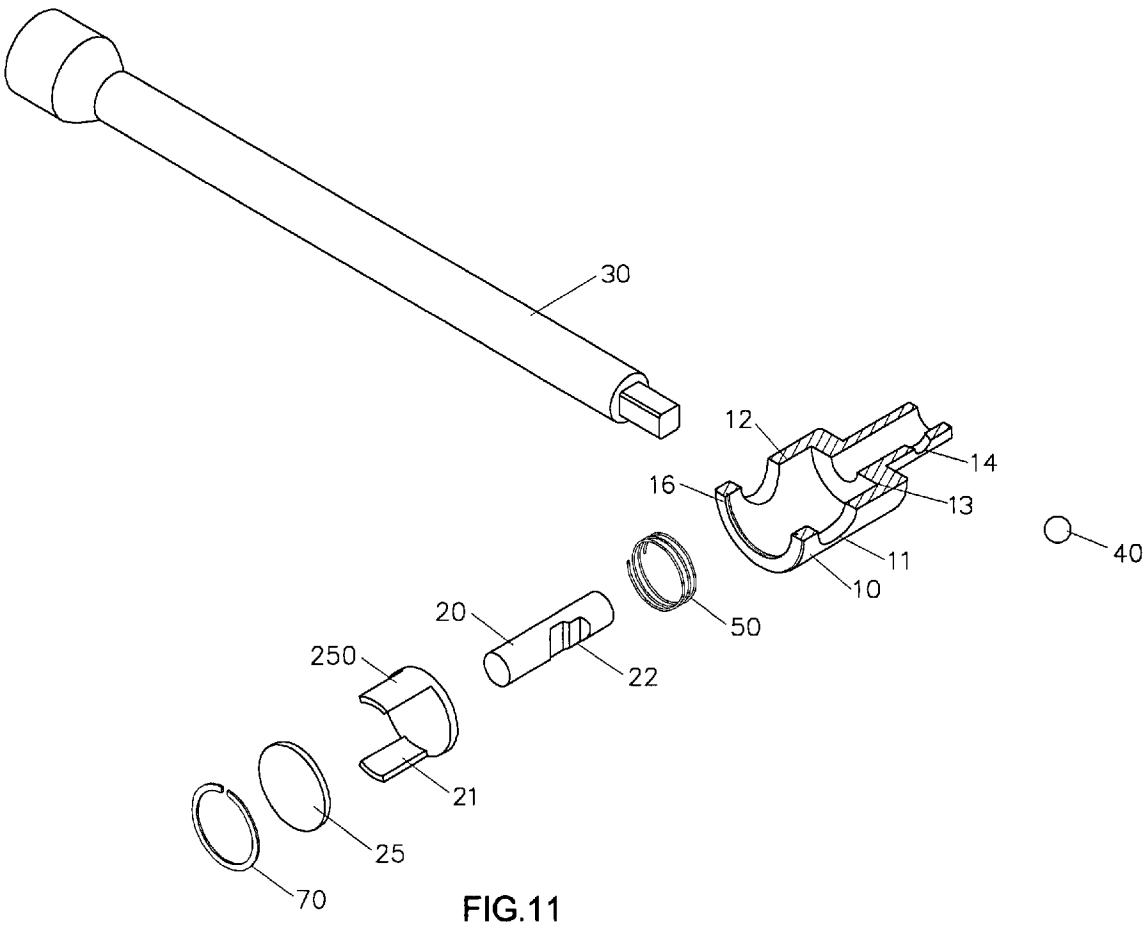
FIG. 11 is a partially cross-sectional exploded perspective view of a socket adapter in accordance with a eighth embodiment of the present invention.

Referring to FIG. 11, a socket adapter in accordance with a eighth embodiment of the present invention is shown, wherein the inner wall of the main body 10 is formed with an annular groove 16, the movable member 20 is substantially rod-shaped, and the socket adapter further comprises a substantially U-shaped resting member 250 mounted in the receiving chamber 12 of the main body 10 and rested on the movable member 20, a push member 25 mounted in the receiving chamber 12 of the main body 10 and rested on the resting member 250, and a C-shaped snap ring 70 secured in the annular groove 16 of the main body 10 and rested on the push member 25, thereby preventing the push member 25 from detaching from the receiving chamber 12 of the main body 10. Thus, the push member 25 is pushed to move the movable member 20 in the receiving chamber 12 of the main body 10.

Figure 12:
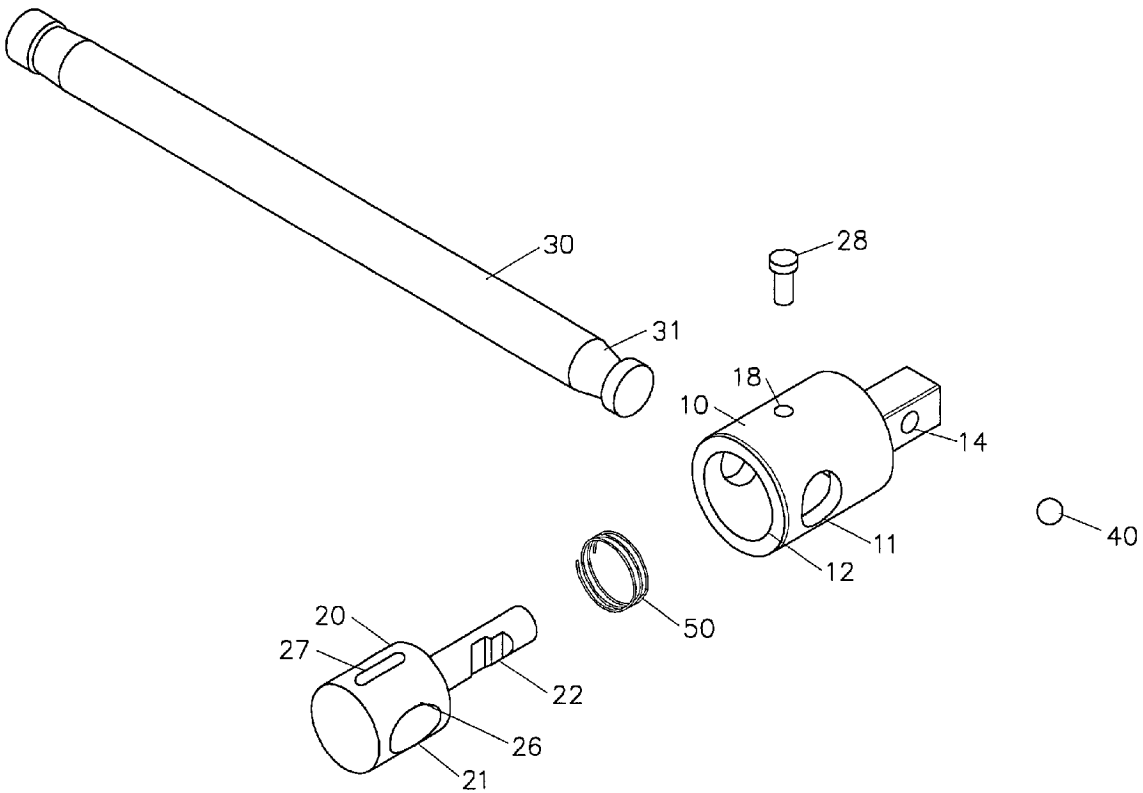
FIG. 12 is a partially cross-sectional exploded perspective view of a socket adapter in accordance with a ninth embodiment of the present invention.

Referring to FIG. 12, a socket adapter in accordance with a ninth embodiment of the present invention is shown, wherein the main body 10 is formed with a screw bore 18, the larger portion of the movable member 20 is formed with an oblong slot 27 aligning with the screw bore 18 of the main body 10 and is formed with a protrusion 26 located adjacent to the elongated hole 21, and the elongated rod 30 has an end formed with an oblique face 31. The protrusion 26 of the movable member 20 includes a ball mating with an elastic member, so that the protrusion 26 is retractable. Thus, the oblique face 31 of the elongated rod 30 is pressed on the protrusion 26 of the movable member 20, thereby preventing the elongated rod 30 from detaching from the main body 10. The socket adapter further comprises a screw member 28 screwed into the screw bore 18 of the main body 10, extended through the oblong slot 27 and urged on the elongated rod 30, so that the elongated rod 30 is fixed on the main body 10.

Figure 13:
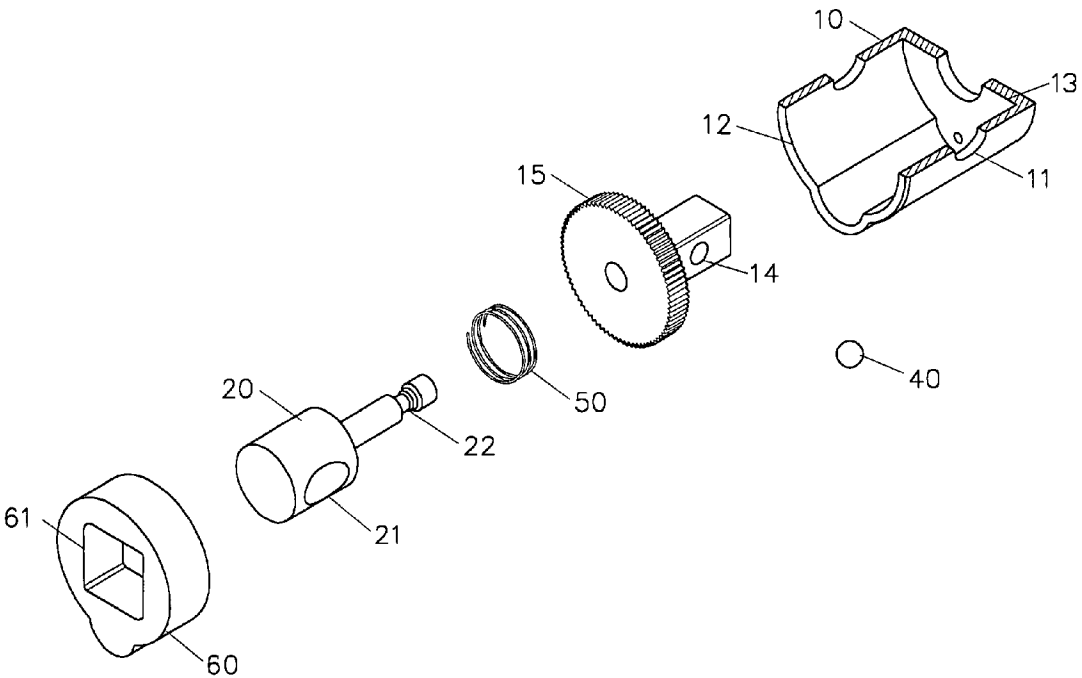
FIG. 13 is a partially cross-sectional exploded perspective view of a socket adapter in accordance with a tenth embodiment of the present invention.
Figure 14:
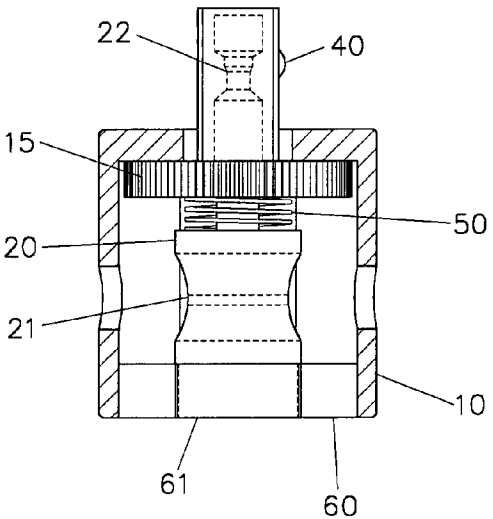
FIG. 14 is a top plan cross-sectional assembly view of the socket adapter as shown in FIG. 13.

Referring to FIGS. 13 and 14, a socket adapter in accordance with a tenth embodiment of the present invention is shown, wherein the elongated rod 30 and the smaller portion of the main body 10 are undefined. The socket adapter further comprises a toothed wheel 15 mounted in the receiving chamber 12 of the main body 10 and formed with a square head, wherein the ball receiving hole 14 is formed in the square head. In addition, the first end of the elastic member 50 is urged on the toothed wheel 15 and the second end of the elastic member 50 is urged on the larger portion of the movable member 20. A pawl member (not shown) is mounted in the receiving chamber 12 of the main body 10, and meshes with the toothed wheel 15. A control member (not shown) is mounted in the receiving chamber 12 of the main body 10, and is secured on the pawl member to pivot the pawl member to mesh with the toothed wheel 15 to control the rotation direction of the square head of the toothed wheel 15. The socket adapter further comprises a top cover 60 secured on the main body 10 and formed with a square mounting recess 61 for mounting the square head (not shown) of a ratchet wrench (not shown).

In operation, the square head of the ratchet wrench is inserted into the square mounting recess 61 of the top cover 60 to rotate the top cover 60 which rotates the main body 10 which rotates the toothed wheel 15 by the pawl member so as to rotate the square head of the toothed wheel 15, so that the socket adapter may function as a ratchet wrench.

Figure 15:
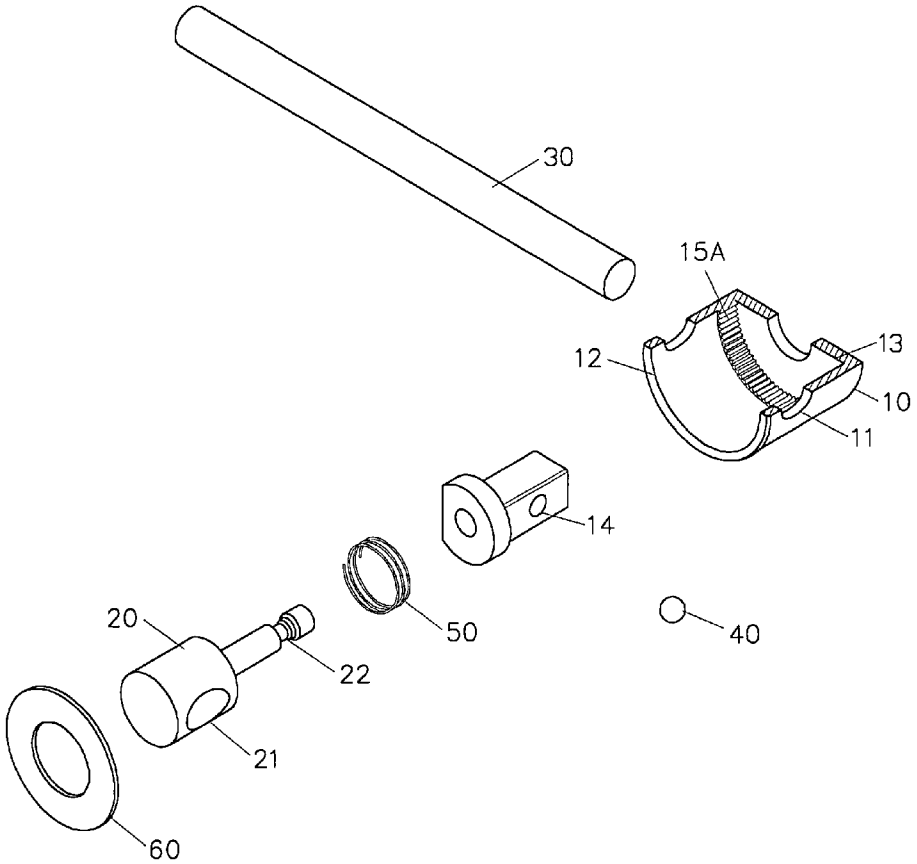
FIG. 15 is a partially cross-sectional exploded perspective view of a socket adapter in accordance with a eleventh embodiment of the present invention.

Referring to FIG. 15, a socket adapter in accordance with a eleventh embodiment of the present invention is shown, wherein the smaller portion of the main body 10 is undefined. The inner wall of the main body 10 is formed with multiple engaging teeth 15A. The socket adapter further comprises a square head mounted in the receiving chamber 12 of the main body 10, wherein the ball receiving hole 14 is formed in the square head 14. In addition, the first end of the elastic member 50 is urged on the square head and the second end of the elastic member 50 is urged on the larger portion of the movable member 20. A pawl member (not shown) is mounted in the receiving chamber 12 of the main body 10, and is rested on a locking face of a rear side of the square head. The pawl member meshes with the engaging teeth 15A. The socket adapter further comprises a top cover 60 secured on the main body 10.

In operation, the elongated rod 30 is rotated to rotate the main body 10 which rotates the engaging teeth 15A which moves the pawl member which rotates the square head, so that the socket adapter may function as a ratchet wrench.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A socket adapter structure, comprising a main body, a movable member, an elongated rod, a ball, and an elastic member, wherein:

the main body has a stepped configuration comprising a larger portion and a non-circular smaller portion for insertion in a corresponding recess in a socket so that the main body can rotate the socket, a through hole in the larger portion, a ball-receiving hole in the square smaller portion, and an inner wall defining a stepped receiving chamber comprising a larger portion in communication with the through hole, a smaller portion in communication with the ball-receiving hole and a shoulder located between the larger portion and the smaller portion;

the movable member is movably mounted in the stepped receiving chamber of the main body, the movable member has a larger portion with an elongated hole aligning with the through hole of the main body and a smaller portion with a stepped face aligning with the ball receiving hole of the main body, the elongated hole of the movable member has a length greater than a diameter of the through hole of the main body, so that the movable member can be pushed further into the stepped receiving chamber of the main body through a determined distance;

the elongated rod is extended through the through hole of the main body and the elongated hole of the movable member and protruded outward from the main body, the elongated rod has a length greater than a diameter of the main body to provide a torque to rotate the main body, the elongated rod has a cross-section having a shape substantially matching that of the through hole of the main body, the elongated rod is slidable axially in the elongated hole of the movable member;

the ball is mounted in the ball receiving hole of the main body and is rested on the stepped face of the movable member so that it can rub against the wall of the recess in the socket, thus retaining the socket on the main body; and the elastic member is mounted in the stepped receiving chamber of the main body and has a first end urged on the shoulder of the main body and a second end urged on the larger portion of the movable member.

2. The socket adapter in accordance with claim 1, wherein the larger portion of the movable member is formed with a square recess.

3. The socket adapter in accordance with claim 1, wherein the larger portion of the movable member is formed with a hexagonal head.

4. The socket adapter in accordance with claim 1, wherein the inner wall of the main body is formed with an annular groove, and the socket adapter further comprises a push member mounted in the receiving chamber of the main body and rested on the larger portion of the movable member, and a C-shaped snap ring secured in the annular groove of the main body and rested on the push member.

5. The socket adapter in accordance with claim 1, wherein the inner wall of the main body is formed with an inner threaded portion, and the socket adapter further comprises a push member mounted in the receiving chamber of the main body and rested on the larger portion of the movable member, and a screw member screwed into the inner threaded portion of the main body and rested on the push member.

6. The socket adapter in accordance with claim 1, wherein the inner wall of the main body is formed with an annular groove, the movable member is substantially T-shaped, and the socket adapter further comprises a substantially U-shaped push member mounted in the receiving chamber of the main body and rested on the larger portion of the movable member, and a C-shaped snap ring secured in the annular groove of the main body and rested on the push member.

7. The socket adapter in accordance with claim 1, wherein the inner wall of the main body is formed with an annular groove, the movable member is substantially rod-shaped, and the socket adapter further comprises a substantially U-shaped resting member mounted in the receiving chamber of the main body and rested on the movable member, a push member mounted in the receiving chamber of the main body and rested on the resting member, and a C-shaped snap ring secured in the annular groove of the main body and rested on the push member.

8. The socket adapter in accordance with claim 1, wherein the larger portion of the movable member had an end flush with an end face of the main body.

* * * * *